US006503125B1

(12) United States Patent
Harrington

(10) Patent No.: US 6,503,125 B1
(45) Date of Patent: Jan. 7, 2003

(54) DUST SHROUD FOR ABRADING MACHINE

(76) Inventor: Raymond J. Harrington, 1906 S. Quaker Ridge Pl., Ontario, CA (US) 91761

( * ) Notice: Subject to any disclaimer, the term of this patent is extended or adjusted under 35 U.S.C. 154(b) by 35 days.

(21) Appl. No.: 09/654,639

(22) Filed: Sep. 5, 2000

(51) Int. Cl.[7] ..... B24B 7/30
(52) U.S. Cl. ..... 451/28; 451/456; 451/451
(58) Field of Search ..... 451/28, 344, 350, 451/352, 353, 358, 359, 451, 452, 453, 454, 455, 456, 457; 125/13.01, 12; 30/124, 390; 83/100

(56) References Cited

U.S. PATENT DOCUMENTS 3,183,629 A * 5/1965 Ver Meulen ..... 451/296 X
3,593,410 A * 7/1971 Taylor ..... 164/34
4,043,701 A * 8/1977 Jaeger ..... 408/241 G
4,132,497 A * 1/1979 Weller et al. ..... 408/241 G
4,192,104 A 3/1980 Patenaude
4,243,011 A * 1/1981 Bodycomb et al. .. 125/13.01 X
4,290,717 A * 9/1981 Aslen ..... 279/148
4,884,927 A * 12/1989 Menker ..... 144/251.2 X
5,392,568 A * 2/1995 Howard et al. ..... 451/344
5,540,210 A * 7/1996 Jones ..... 125/13.01
5,564,408 A * 10/1996 Bassols ..... 125/12 X
5,575,271 A * 11/1996 Chiuminatta et al. ..... 125/12 X
6,257,222 B1 * 7/2001 Kaeser ..... 125/12 X
6,318,352 B1 * 11/2001 Gnazzo et al. ..... 125/12 X

* cited by examiner

*Primary Examiner*—Eileen P. Morgan
*Assistant Examiner*—Hadi Shakeri
(74) *Attorney, Agent, or Firm*—Procopio, Cory, Hargreaves & Savitch, LLP

(57) ABSTRACT

A dust shroud for use with a vacuum source and an abrading machine having a rotating abrading wheel includes a dust shroud housing adapted to be connected to the vacuum source and mounted to the abrading machine. The dust shroud housing includes a front wall with a front opening through which the abrading wheel may be accessed. A sliding door is slidably mounted to the front wall of the dust shroud housing for selectively covering the front opening.

23 Claims, 9 Drawing Sheets

DUST SHROUD FOR ABRADING MACHINE

FIELD OF THE INVENTION

The present invention relates, in general, to shrouds or hoods for use with dust creating machines, and, in particular, to shrouds or hoods for use with abrading machines.

DISCUSSION OF RELATED ART

Dust creating machines such as grinding machines having grinding wheels are notorious for producing dust-laden air, grit and metal particles during operation. Dust shrouds that partially envelop grinding wheels were developed in order to reduce some of this pollution by drawing the dust, grit and metal particles through the dust shroud using a remote vacuum operated exhaust system. By employing a dust shroud connected to a vacuum, much of the dust-laden air resultant from wheel rotation during operational use can be effectively removed away from the area of the grinding wheel and the machine operator. An example of such a dust shroud is disclosed in U.S. Pat. No. 4,192,104 to Patenaude.

The manufactured dust shroud corresponding to U.S. Pat. No. 4,192,104 is equipped with an inspection or access door that facilitates inspection and changing of the grinding wheel. The access door is hinged to a front wall of the dust shroud housing at the top or sides of an opening in the front wall of the housing. A problem with a hinged access door is that the workpiece or other equipment positioned directly in front of the hinged access door impedes an operator's ability to open the door.

Another disadvantage of the hinged access door is that it can only be maintained in either a filly closed position or a fully open position (if specially rigged), and can not be maintained in a partially opened position. Quite often, it is desirable to have the hinged access door at least partially open during operation of the grinding wheel in order to surface grind certain workpieces or to inspect the wheel. Because the hinged door can not be maintained in a partially opened position, when it is desirable for the hinged door to be in a partially opened position, the hinged door must be rigged so that it is in a filly open position. Most of the suction power that is provided by the vacuum source is lost when the hinged door is in the fully open position, rendering the shroud ineffective. Further, with the hinged door in the fully open position, the operator's personal safety is compromised during use because the grinding wheel is not covered and the operator's health is compromised because dust, grit and metal particles are allowed to blow out of the opening in the front wall of the housing, into the operator. Therefore, the present inventor has recognized a need exists for an adjustable dust shroud access door that is capable of being selectively positioned for a variety of partially opened conditions.

A further disadvantage of the manufactured dust shroud corresponding to U.S. Pat. No. 4,192,104 is that it is made by a sand casting process. Sand casting requires a new mold construction for each shroud produced and necessitates a considerable amount of clean up. As a result, the sand casting manufacturing process is slow, labor intensive and costly. Also, the sand casting process is incapable of producing a light-weight shroud construction for several reasons. First, larger and thicker amounts of molten material are required to prevent the molten material from inadvertently hardening during introduction of the molten material into the mold. Second, the sand casting process is incapable of producing thin wall sections, which are required to produce a lighter weight dust shroud. The present inventor has recognized that a light-weight shroud would be easier to handle and extend the life of all grinding machine components prone to premature wear and failure caused by unnecessarily heavy dust shrouds.

In addition, the rough, porous sand cast finish on the dust shroud has proven to be detrimental to the performance of the shroud because it causes the particles of dust, grit and metal to stick to the porous walls of the interior vacuum channels. Inevitably, the dust, grit and metal build-up causes a slower air speed of dust-laden air through the shroud, resulting in a reduction in the interior volume of the vacuum channels of the shroud. Occasionally, a complete restriction of the vacuum channels and a loss of all suction power occurs if the housing is not effectively unclogged. Once the housing begins to clog up, it is difficult or impossible to service since it is a one-piece design and can not be taken apart for a proper cleaning. Consequently, the present inventor has recognized a need exists to manufacture a multi-piece dust shroud using an improved, cost-efficient process that produces a better dust shroud.

SUMMARY OF THE INVENTION

An aspect of the invention involves a dust shroud for use with a vacuum source and an abrading machine having a rotating abrading wheel. The dust shroud includes a dust shroud housing adapted to be connected to the vacuum source and mounted to the abrading machine. The dust shroud housing includes a front wall with a front opening through which the abrading wheel may be accessed. A sliding door is slidably mounted to the front wall of the dust shroud housing for selectively covering the front opening.

Another aspect of the invention involves a sliding door assembly for a dust shroud. The dust shroud is adapted for use with a vacuum source and an abrading machine having a rotating abrading wheel. The dust shroud includes a dust shroud housing having a front wall with a front opening through which the abrading wheel may be accessed. The sliding door assembly includes a sliding door adapted to be slidably mounted to the front wall of the dust shroud housing for selectively covering the front opening. In one implementation, the front wall of the housing includes a mounting portion integrated with the front wall, and the sliding door is adapted to be slidably mounted to the mounting portion. In an alternative implementation, the sliding door assembly further includes an adapter bracket adapted to be mounted to the front wall and slidably receive the sliding door.

An additional aspect of the invention involves a method of controlling the size of a front access opening of a front wall of a dust shroud, where the dust shroud is for use with a vacuum source and an abrading machine having a rotating abrading wheel. The method includes providing a sliding door slidably mounted to the front wall of the dust shroud, and sliding the door to a location that minimizes the interference with a workpiece, but maximizes vacuum suction. In one implementation, the dust shroud includes a mounting portion integrated with the front wall, and providing a sliding door includes the step of providing a sliding door slidably mounted to the mounting portion. In an alternative implementation, the dust shroud includes an adapter bracket mounted to the front wall, and providing a sliding door includes the step of providing a sliding door slidably mounted to the adapter bracket.

A further aspect of the invention involves a method of retrofitting a sliding door assembly to a dust shroud, where the dust shroud is for use with a vacuum source and an abrading machine having a rotating abrading wheel. The dust shroud includes a dust shroud housing having a front wall with a front opening through which the abrading wheel may be accessed. The method includes removing a hinged door from the front wall of the dust shroud, and mounting a sliding door assembly to the front wall, the sliding door assembly including an adapter bracket and a slidable door adapted to be slidably received by the adapter bracket.

Another aspect of the invention involves a method of manufacturing a dust shroud for use with a vacuum source and an abrading machine having a rotating abrading wheel. The method includes die casting a front dust shroud housing portion, die casting a rear dust shroud housing portion, and attaching the front and rear dust shroud housing portions together to form a dust shroud housing.

An additional aspect of the invention involves a bracket assembly for mounting a dust shroud to an abrading machine. The dust shroud includes an alignment bar. The abrading machine includes a spindle housing with a circular portion surrounding a spindle adapted to carry an abrading wheel. The bracket assembly includes a circular clamp section adapted to be rotatably mounted to the circular portion of the spindle housing for rotatable angular adjustability of the dust shroud relative to the abrading wheel, and a forked portion adapted to receive the alignment bar of the dust shroud for radial adjustability of the dust shroud relative to the abrading wheel.

Another aspect of the invention involves a method of mounting a dust shroud to an abrading machine. The method includes rotatably mounting a circular clamp section of a bracket assembly to a circular portion of a spindle housing of the abrading machine, and radially mounting an alignment bar of the dust shroud to a forked portion of the bracket assembly.

A further aspect of the invention involves a bracket assembly for mounting a dust shroud having an alignment bar to an abrading machine having a spindle housing with a spindle adapted to carry an abrading wheel. The bracket assembly includes a circular adapter adapted to be mounted to the spindle housing around the spindle, a bracket including a circular clamp section adapted to be rotatably mounted to the circular adapter for rotatable angular adjustability of the dust shroud relative to the abrading wheel, and a forked portion adapted to receive the alignment bar of the dust shroud for radial adjustability of the dust shroud relative to the abrading wheel.

A still further aspect of the invention involves a method of mounting a dust shroud to an abrading machine. The method includes mounting a circular adapter of a bracket assembly to a spindle housing of an abrading machine, around a spindle of the spindle housing, rotatably mounting a circular clamp section of a bracket to the circular adapter, and radially mounting an alignment bar of a dust shroud to a forked portion of the bracket.

Other features and advantages of the invention will be evident from reading the following detailed description, which is intended to illustrate, but not limit, the invention.

BRIEF DESCRIPTION OF THE DRAWINGS

The drawings illustrate the design and utility of preferred embodiments of the present invention, in which similar elements are referred to by common reference numerals.

DETAILED DESCRIPTION OF THE PREFERRED EMBODIMENTS

Figure 1:
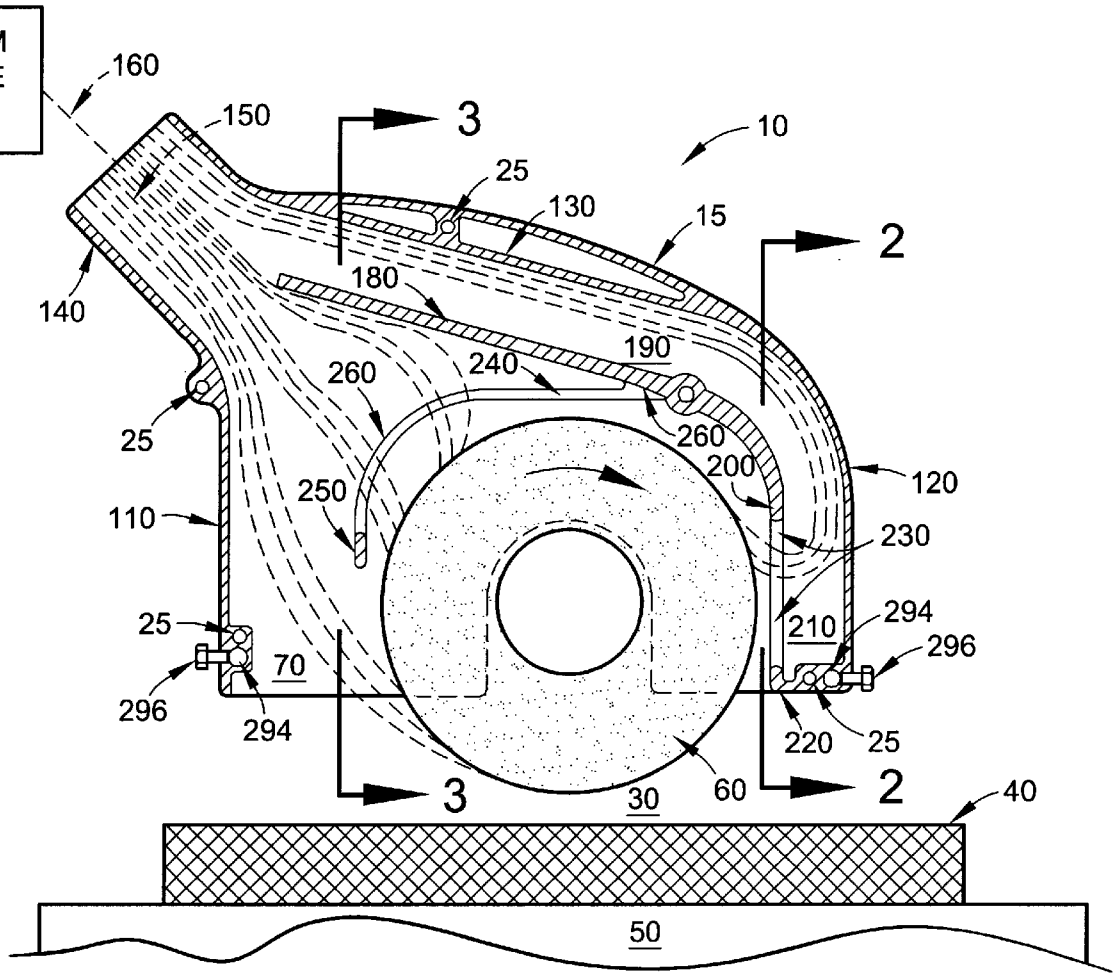
FIG. 1 is a cross-sectional view along the vertical centerline of an embodiment of the dust shroud.
Figure 2:
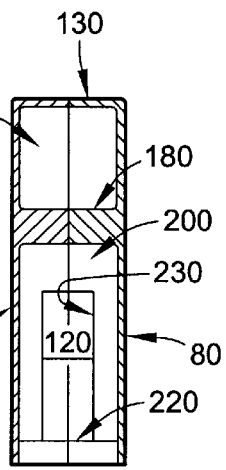
FIG. 2 is a cross-sectional view of the dust shroud along line 2—2 of FIG. 1.

With reference to FIGS. 1–5, an embodiment of a dust shroud 10 will now be described. The dust shroud 10 includes a dust shroud housing 15 adapted for use with a remote vacuum source 20 for removing dust-laden air from the vicinity of an abrading machine such as a grinding machine 22 (FIGS. 4A, 4B) having a grinding wheel 60. The remote vacuum source 20 is designed to draw dust, grit and metal particles through the housing 15 to effectively control and eliminate dirty and hazardous dust laden air from the grinding machine work area.

Figure 7A:
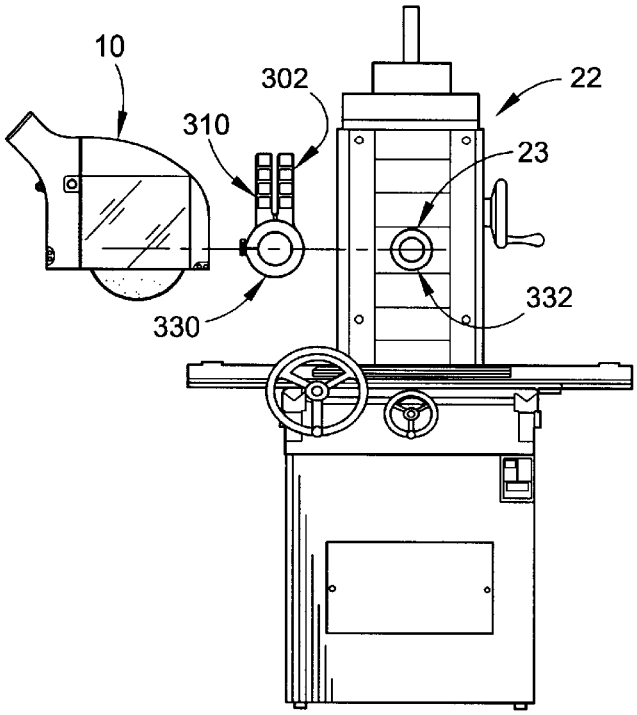
FIG. 7A is a front side elevational view of a grinding machine, and illustrates the dust shroud of FIG. 5 and the bracket assembly of FIG. 6A separated from the grinding machine.
Figure 7B:
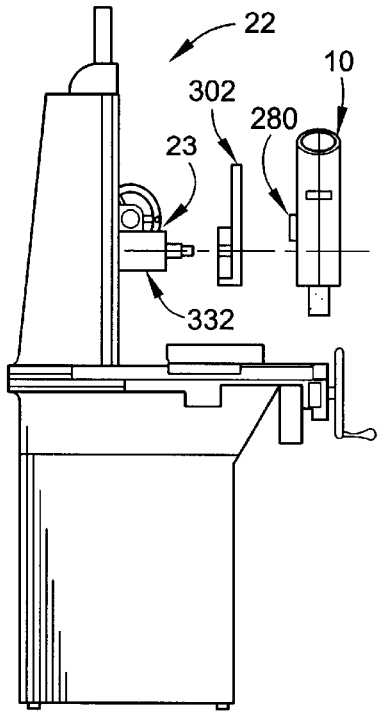
FIG. 7B is a left side elevational view of the grinding machine, dust shroud and the bracket assembly illustrated in FIG. 7A.
Figure 7C:
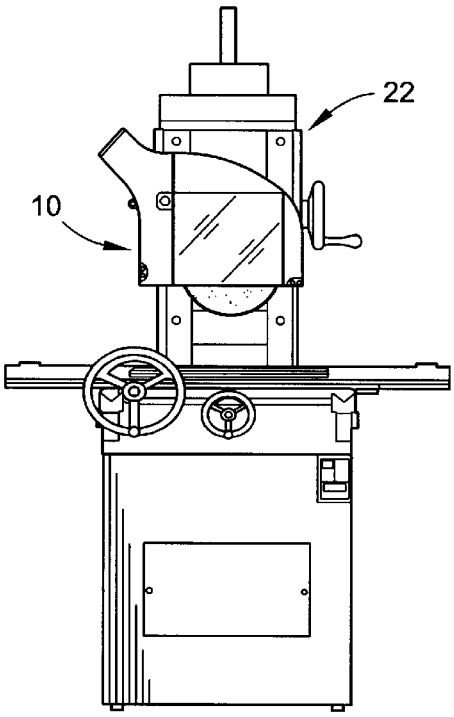
FIG. 7C is a front side elevational view of the grinding machine, dust shroud and the bracket assembly illustrated in FIG. 7A with the dust shroud and bracket assembly assembled on the grinding machine.
Figure 7D:
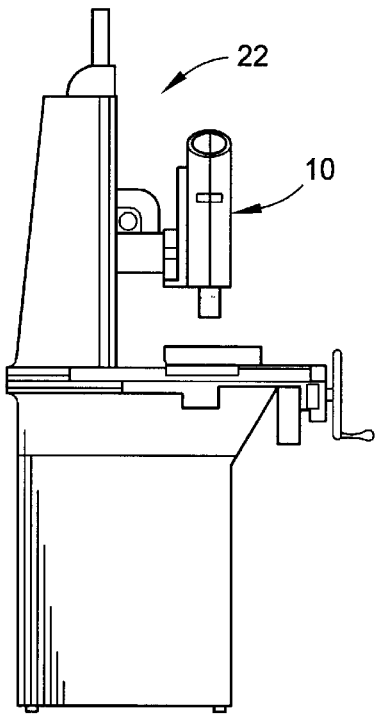
FIG. 7D is a left side elevational view of the grinding machine, dust shroud and the bracket assembly illustrated in FIG. 7C with the dust shroud and bracket assembly assembled on the grinding machine.

In use, the dust shroud housing 15 is mounted on a spindle housing 23 (FIGS. 7A, 7B) of a grinding machine 22. The spindle housing 23 carries a rotating spindle that the grinding wheel 60 is mounted to for rotation. The spindle housing 23 may be moved vertically away from a workpiece 30 to represent an ascending movement of the wheel 60 and shroud 10 and toward the workpiece 30 to represent a descending movement of the wheel 60 and shroud 10. Rotation of the wheel 60, as shown by R, is generally in the clockwise direction.

The workpiece 30 may be held in place by a magnetic device 40 on a reciprocating table 50 of the machine 22.

The dust shroud 10 may be mounted to the spindle housing 23 by a bracket assembly to be described. The dust shroud 10 surrounds the majority of the wheel 60. Generally, the housing 15 should enclose the entire top half of the wheel 60 and as much of the bottom half of the wheel 60 as is practical to avoid interference with the workpiece 30 during grinding. Additionally, as described in more detail below, the shroud 10 may be angled and moved radially with respect to the wheel 60 so that the shroud 10 can be adjusted to work effectively with wheels 60 of different diameters and with workpieces 30 of different shapes and sizes, while covering as much of the wheel 60 as possible.

The dust shroud housing 15 preferably includes a two-piece construction comprising a front member 64 and a rear member 66. The two members 64, 66 are preferably die casted and made of aluminum. In an alternative embodiment, the two members 64, 66 may be injection molded and made of plastic as long as the material is sufficiently strong enough to withstand the impact of a disintegrating grinding wheel. The two members 64, 66 may be aligned by various interlocking and sealing features and connected with threaded fasteners through screw holes 25 to form the complete dust shroud housing 15.

In the past, dust shrouds such as that illustrated in U.S. Pat. No. 4,192,104 were sand casted using sand bonded with clay. Sand casting such a dust shroud is disadvantageous because the clay-bonded sand requires moisture, which along with loose sand can cause various casting defects. Additionally, a sand mold can only be used once because the heat of molten metal breaks clay bonds.

An advantage of the two-piece shroud 10 is that it permits easy maintenance, particularly when cleaning out accumulated dust and debris for maximum dust shroud efficiency because the two members 64, 66 can be separated and cleaned.

Also, the two piece die cast aluminum construction is superior to prior art sand casted shrouds especially with respect to smoothness, accuracy and overall quality of the product. Because the die cast or plastic injection molded surfaces of the interior vacuum channels of the shroud 10 are considerably smoother than the sand cast surfaces of the prior art dust shrouds, increased airflow and, therefore, higher dust removal rates are produced. Thus, a dust shroud housing 15 having more efficient vacuum channel flow characteristics can be produced using the present die cast aluminum or plastic injection molded methods.

Another advantage of die casting and injection molding is the ability to produce the shroud 10 with substantially thinner wall sections, greatly reducing the overall weight (approximately 15%) of the apparatus compared to comparable sand casted shrouds without sacrificing quality or functionality. Thus, less effort is required on behalf of a machine operator to adjust the dust shroud housing 15. Also, the lighter weight construction extends the life of all of the machine components, e.g., spindle height adjustment mechanisms, affected by premature wear and failure caused by the considerably heavier prior art devices. Additional advantages of utilizing die casting or injection molding include higher production rates for mass production, closer tolerances, minimal subsequent machining and low part cost at high volume production.

With reference to FIGS. 1–3 and 5, the shroud housing 15 includes opposite side walls 70, 80 comprising a far or rear side 70 and a near or front side 80 having a wheel access opening 90. The housing 15 also includes a left end wall 110 that connects the sides 70, 80, a right end wall 120 that connects the sides 70, 80, a contoured inclined upper top wall 130 that connects the sides 70, 80 and the front wall 120, and an inclined lower top wall 140 that connects the sides 70, 80 and merges with the upper portion of the left end wall 110. The left ending of each of the top walls 130, 140 and the left ending of the upper portion of each side wall 70, 80 together define a tubular chamber section 150 in which all of a variety of vacuum channels connect and which may be connected by piping 160 or other flexible hose means to the vacuum source 20.

A primary vacuum channel 170 is defined by the sidewalls 70, 80 and the lower left wall 110. A first internal wall 180 extends between the sidewalls 70, 80 and is spaced appropriately in relationship to the upper top wall 130 to form a secondary vacuum channel 190. The first internal wall 180 includes a right vertically curving extension 200 that extends between the spaced sidewalls 70, 80 appropriately from and generally parallel to right wall 120 to define an extension and continuation of the secondary vacuum channel 190. The first internal wall 180 includes a left terminus that terminates adjacent to the primary vacuum channel 170 and a right terminus in the form of a first end wall portion 220 that extends between the lower extremities of the walls 120, 200.

The wall section 200 has an opening 230 that allows vacuum suction to pull the dust-laden air and other debris thrown off the grinding wheel 60 into and through the secondary vacuum channel 190. The opening 230 has a slightly narrower width than the width of the grinding wheel 60.

Extending left from the first internal wall 180 at approximately the point just before it starts to join the curved section of wall 200 is a generally horizontally arranged second internal wall 240 extending left for a distance before it curves downward to a point 250. The second internal wall 240 is designed to follow the circumference of the grinding wheel 60, when present, and has an opening 260 to allow additional vacuum suction.

The construction of the dust shroud housing 15 is such that dust-laden air is drawn through the vacuum channels 170, 190 divided by means of the internal walls 180, 240 having openings 230, 260 within the interior of the housing 15. These openings 230, 260 are strategically arranged around the perimeter of the grinding wheel 60 so as to pull dust laden air away from the rotating grinding wheel 60 and through the vacuum channels 170, 190. Preferably, the openings 230, 260 are narrowed slots that restrict the air flow therethrough so that the pressure throughout the system is increased, thereby triggering an increase in air velocity and overall suction effect. Because the openings 230, 260 are centered around the periphery of the grinding wheel 60, maximum suction pressure is created along the perimeter of the wheel 60 where the highest concentration of dust and debris is centered. Ultimately, the dust-laden air is sucked through the tubular chamber section 150, out of the housing 15, and into the vacuum source 20.

With reference specifically to FIG. 1, the rotation R of the grinding wheel 60 is in a clockwise direction such that the greater portion of the dust generated by the grinding machine is drawn left, away from the wheel 60 between the 6 o'clock and 12 o'clock positions through the primary vacuum channel 170. Other portions of the dust-laden air not initially pulled from the rotating wheel 60 or the air cushion orbiting around it between the 6 and 12 o'clock positions will be removed from the wheel 60 through the secondary vacuum channel 190. The openings 230, 260 in the internal walls 180, 240 are designed to take advantage of the air speed generated by the centrifugal force of the rotating grinding wheel 60 to increase the suction power and improve the efficiency of the dust shroud.

Figure 3:
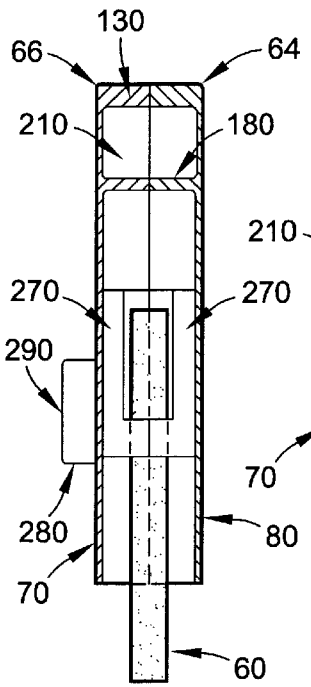
FIG. 3 is a cross-sectional view of the dust shroud along line 3—3 of FIG. 1.

With reference additionally to FIG. 3, the width of the opening 260 is much narrower than the width of the grinding wheel 60 so as to define baffle means 270 at opposite sides of the wheel 60 in the form of wall portions 270. The baffle means 270 serve to concentrate the suction power from the vacuum source 20 onto the circumference of the rotating grinding wheel 60. As the grinding wheel 60 contacts the workpiece 30 and shards of debris fly off the workpiece 30, some of the shards are cast into the primary vacuum channel 170 and drawn into the vacuum source 20. Meanwhile, other shards of debris that remain attached to the grinding wheel's porous surface as the grinding wheel 60 rotates around to opening 230 are eventually pulled through the opening 230 into secondary vacuum channel 190 and swept into the vacuum source 20.

The rear wall 70 of the housing 15 has an alignment bar 280 (FIG. 3) comprising a vertically elongated protrusion having a threaded hole 290 near its midpoint. The alignment bar 280 is used to align and mount the shroud 10 to the spindle housing 23 (FIGS. 10, 11) of the grinding machine 22 through a bracket assembly to be described.

With reference to FIG. 1, the shroud housing 15 may include one or more indicator mounting holes 294 for accommodating indicators or other accessories used to assist in grinding. Any of a variety of measurement or checking devices routinely used to align the workpiece 30 with the grinding wheel 60 may be attached to the shroud 10 using the indicator mounting holes 294. Locking screws 296 or other fasteners may be used to lock such a measurement device(s) within the indicator mounting holes 294. The mounting holes 294 provide a simple and convenient way to attach measurement or checking devices, improving operator efficiency and productivity.

With reference to FIGS. 6A, 6B and 7A–7D, an embodiment of an attachment bracket assembly 300 will now be described. In a preferred embodiment, the attachment bracket assembly 300 includes an attachment bracket 302 that permits angular and radial adjustability of the dust shroud 10 with respect to the grinding wheel 60. The attachment bracket 302 includes a flat shroud-mounting section 310. The shroud-mounting section 310 is forked and includes arms 315 separated by an elongated slot 320. The arms 315 may include one or more hollow sections 317 to reduce the weight of the bracket 302. The elongated slot 320 is adapted to receive the alignment bar 280 of the shroud 10. The attachment bracket 302 also includes a circular clamp section 330 adapted to be clamped about a circular portion 332 (FIGS. 7A, 7B) of the spindle housing 23. Preferably, the bracket 302 is die casted and made of aluminum.

In use, the shroud 10 may be mounted to the bracket 302 by sliding the alignment bar 280 within the slot 320 a distance corresponding to a desired shroud height level. A threaded fastener (not shown) having an oversized head may be inserted through the slot 320 and threadably attached to the threaded hole 290 in the alignment bar 280 in order to secure the shroud 10 at a preferred radial distance relative to the grinding wheel 60. The circular clamp 330 may be slid over the circular portion 332 of the spindle housing 23 and rotated at a desired angle relative to the wheel 60 and workpiece 30. To maintain the bracket 302 and shroud 10 in this position around the circular portion 332 of the spindle housing 23, a threaded fastener 340 is tightened, causing the clamp 330 to tighten around the circular portion 332. Loosening the threaded fastener 340 allows an operator to angularly adjust the shroud 10 about the circular portion relative to the workpiece 30. Thus, the bracket 302 is multi-functional in that it allows radial and angular adjustability of the shroud 10 relative to the grinding wheel 60, allowing workpieces 30 of a variety of configurations to be worked on with minimal or no interference from the shroud 10.

In an alternative embodiment, the shroud 10 may be mounted to the spindle housing 23 by, first, attaching the clamp 340 of the bracket 302 to the circular portion 332 of the spindle housing 23 at a desired angle relative to the wheel 60, and, then, mounting the shroud 10 to the bracket 302 at a desired radial distance relative to the wheel 60.

Figure 9:
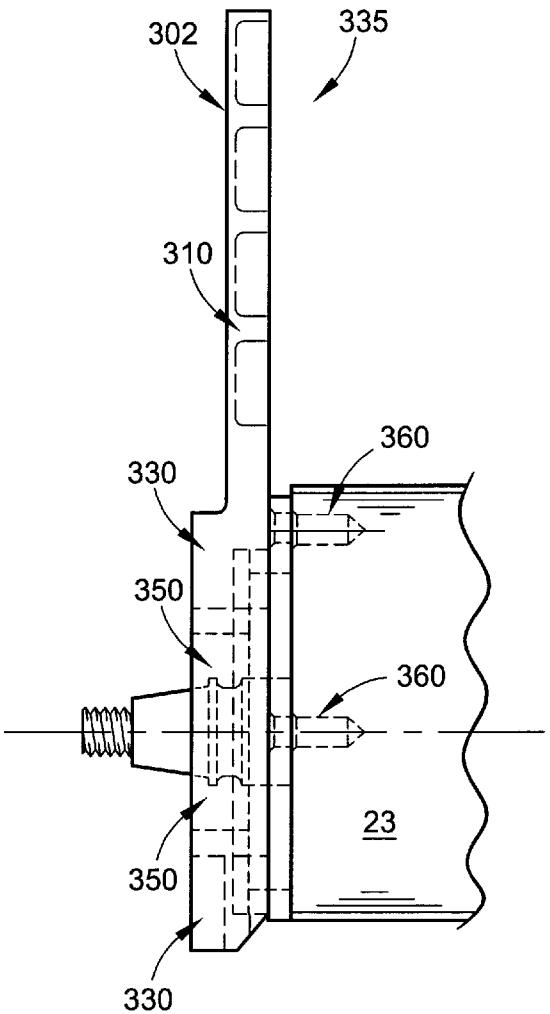
FIG. 9 is cross-sectional view the bracket assembly of FIG. 8 assembled on a portion of a spindle housing of a grinding machine.
Figure 8:
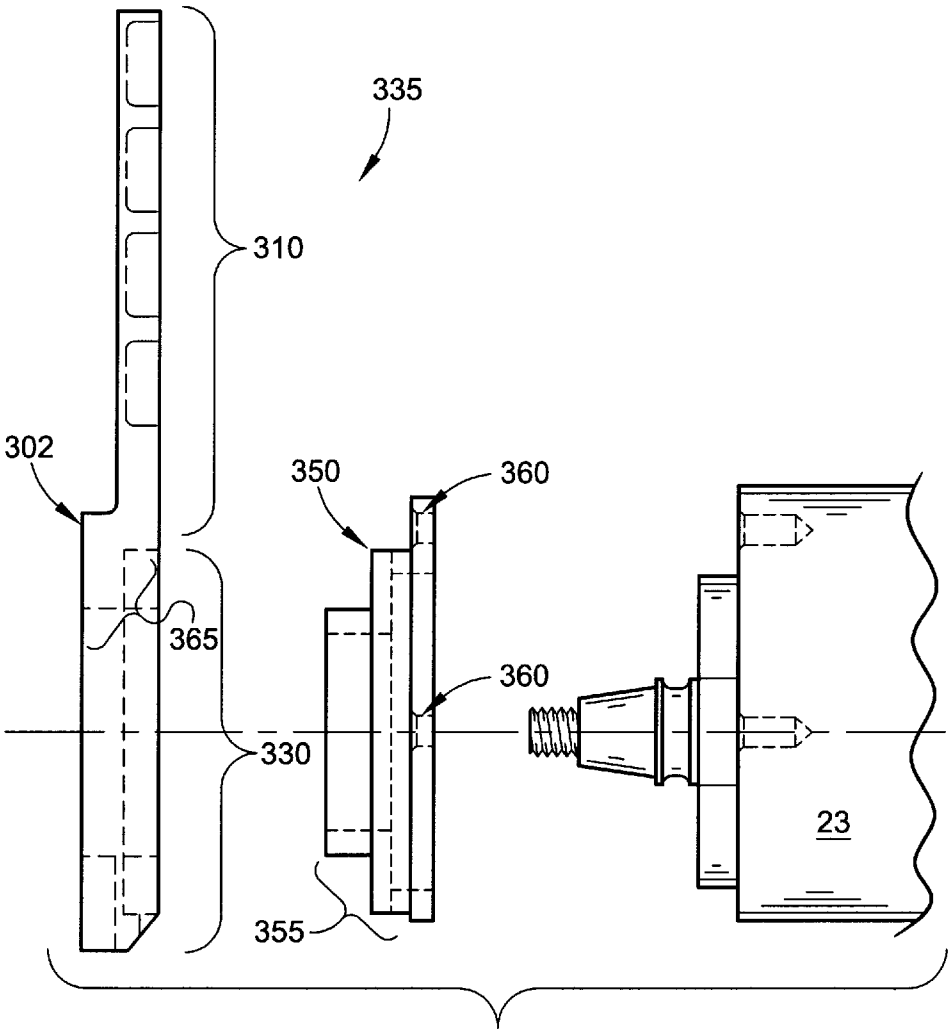
FIG. 8 is an exploded cross-sectional view of an alternative embodiment of a bracket assembly for mounting the dust shroud of FIG. 1 to a grinding machine, and illustrates a portion of a spindle housing of a grinding machine.
Figure 10:
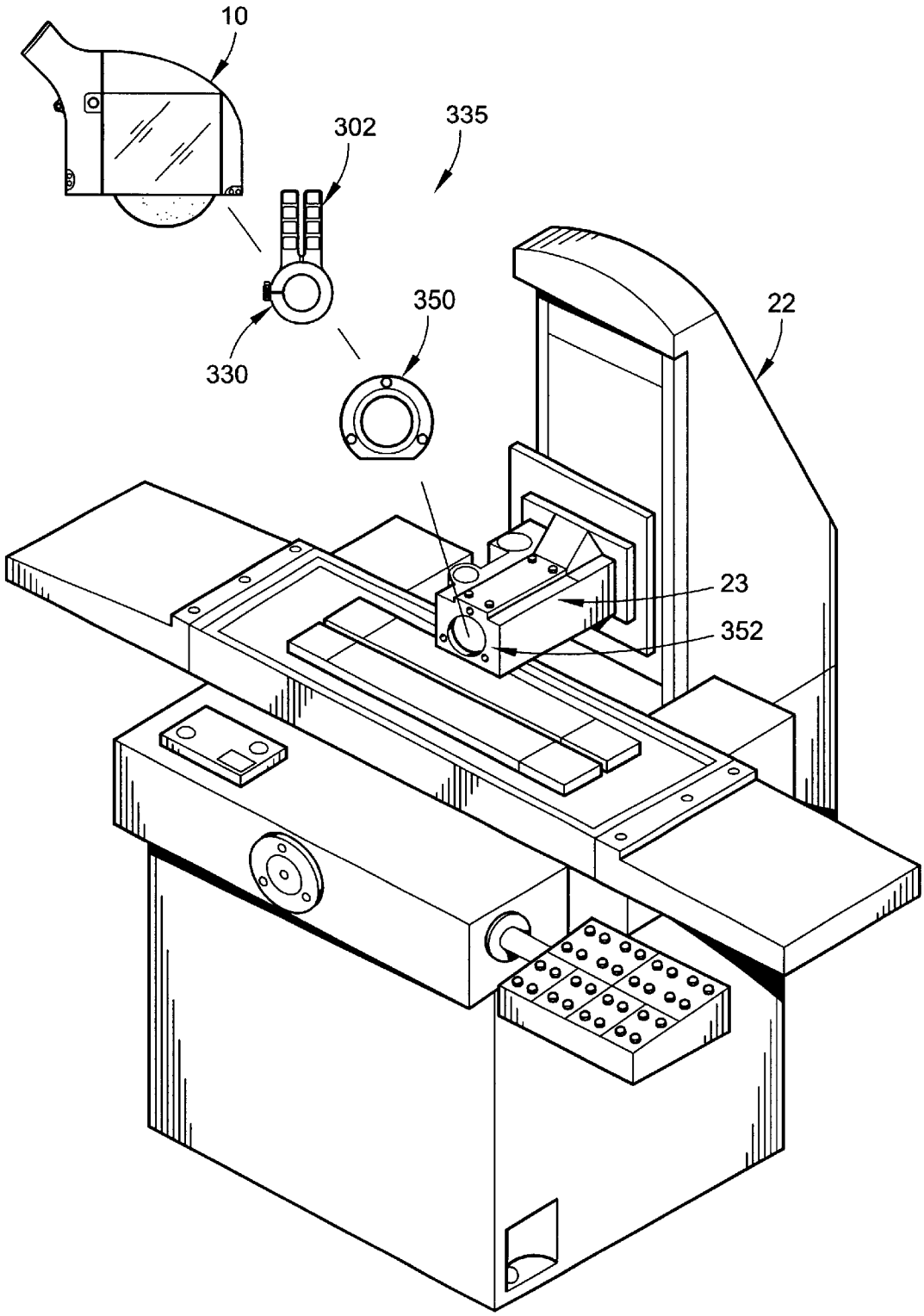
FIG. 10 is a perspective veiw of a grinding machine, and illustrates the dust shroud of FIG. 5 and the bracket assembly of FIGS. 8 and 9 separated from the grinding machine.

With reference to FIGS. 8–10, an alternative embodiment of an attachment bracket assembly 335 will now be described. The attachment bracket assembly 335 is a two-piece attachment bracket assembly that allows for radial and angular adjustability of the shroud 10 where a circular portion 332 (FIGS. 7A, 7B) of sufficient dimensions does not exist on the spindle housing 23 of the grinding machine 22 for mounting the clamp 330 thereto. The attachment bracket assembly 335 includes the aforementioned attachment bracket 302 and a circular adapter 350 configured to be mounted to a front face 352 of the spindle housing 23. The circular adapter 350 is designed to be disposed between the attachment bracket 302 and the spindle housing 23. The circular adapter 350 includes a stepped concentric protrusion 355 dimensioned to be received by a stepped concentric recession 365 in the attachment bracket 302 such that rotation of the attachment bracket 302 relative to the adapter 350 is permitted. The adapter 350 further includes a plurality of threaded fastener holes 360 adapted to receive threaded fasteners for mounting the adapter 350 to a front face 352 of the spindle housing 23.

In use, the adapter 350 is mounted to the spindle housing 23 with multiple threaded fasteners. Then, as described above, the bracket 302 is mounted to the shroud 10 followed by the bracket 302 being mounted to the adapter 250. Alternatively, the bracket 302 may be mounted to the adapter 350 followed by the shroud 10 being mounted to the bracket 302.

Figure 4A:
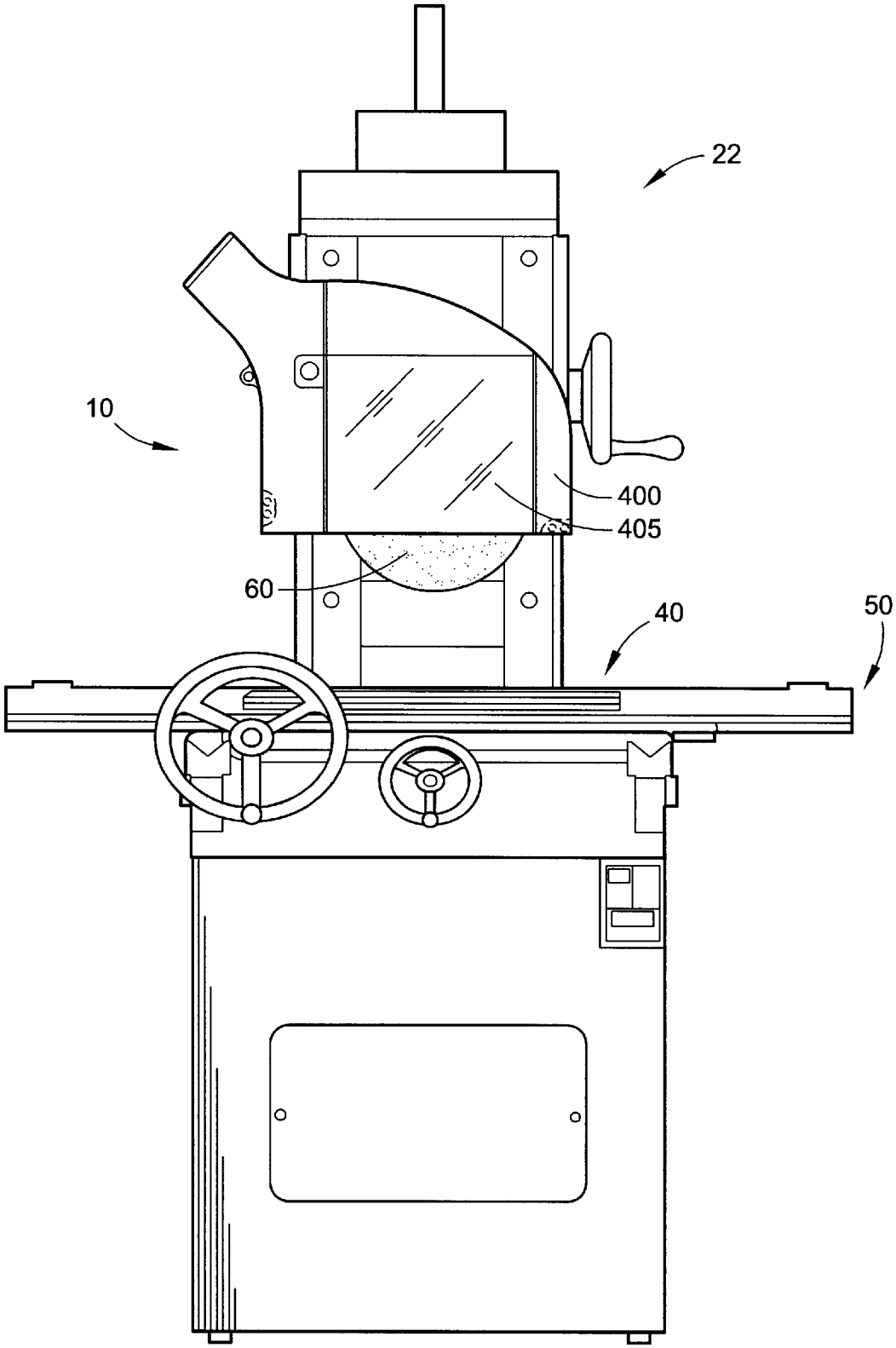
FIG. 4A is a front elevational view of the dust shroud of FIG. 1 mounted to a grinding machine, and illustrates a sliding access door in a filly closed or lowered position.
Figure 4B:
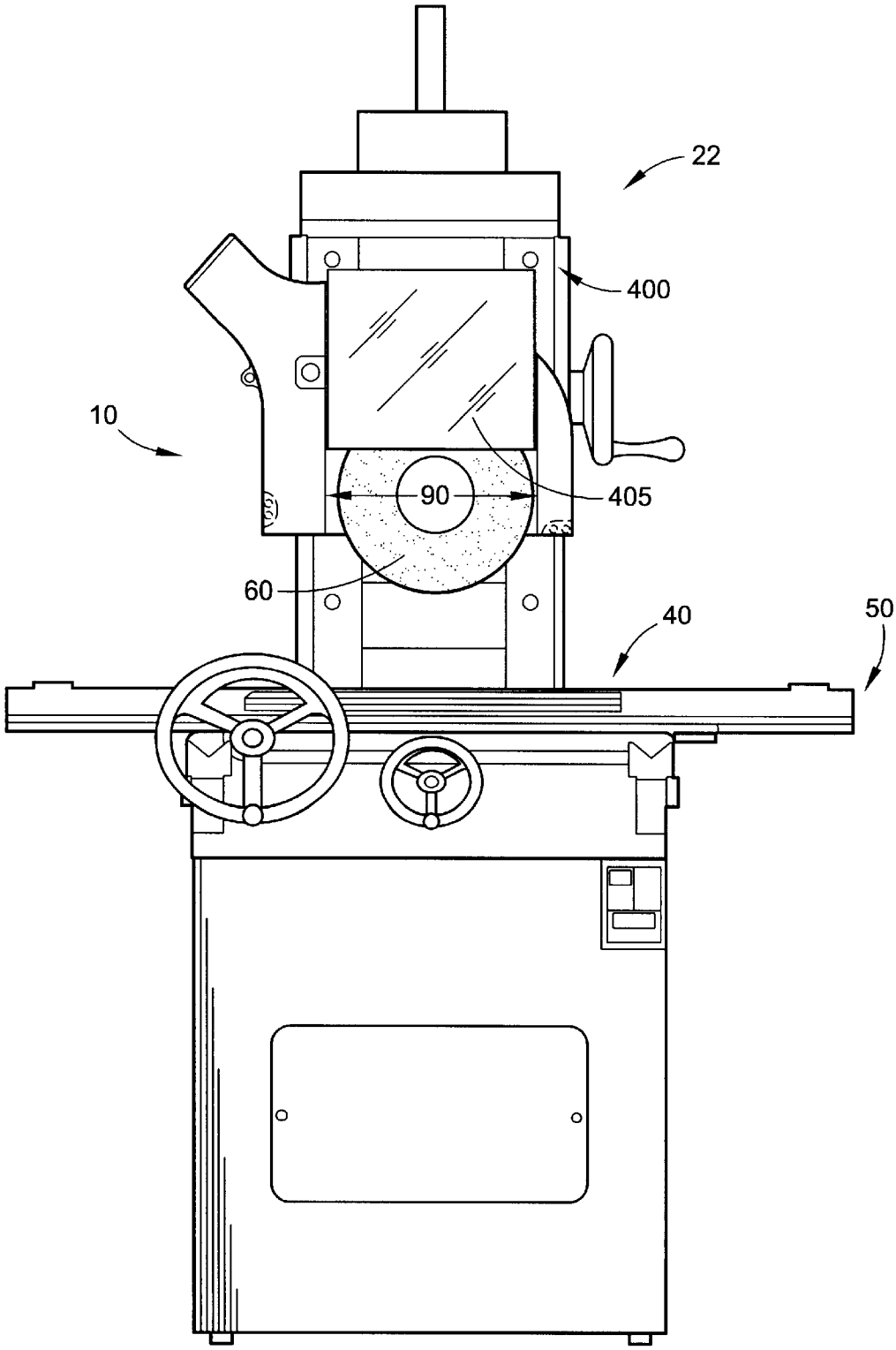
FIG. 4B is a front elevational view of the dust shroud of FIG. 1 mounted to a grinding machine, and illustrates the sliding access door in a partially open or raised position.
Figure 5:
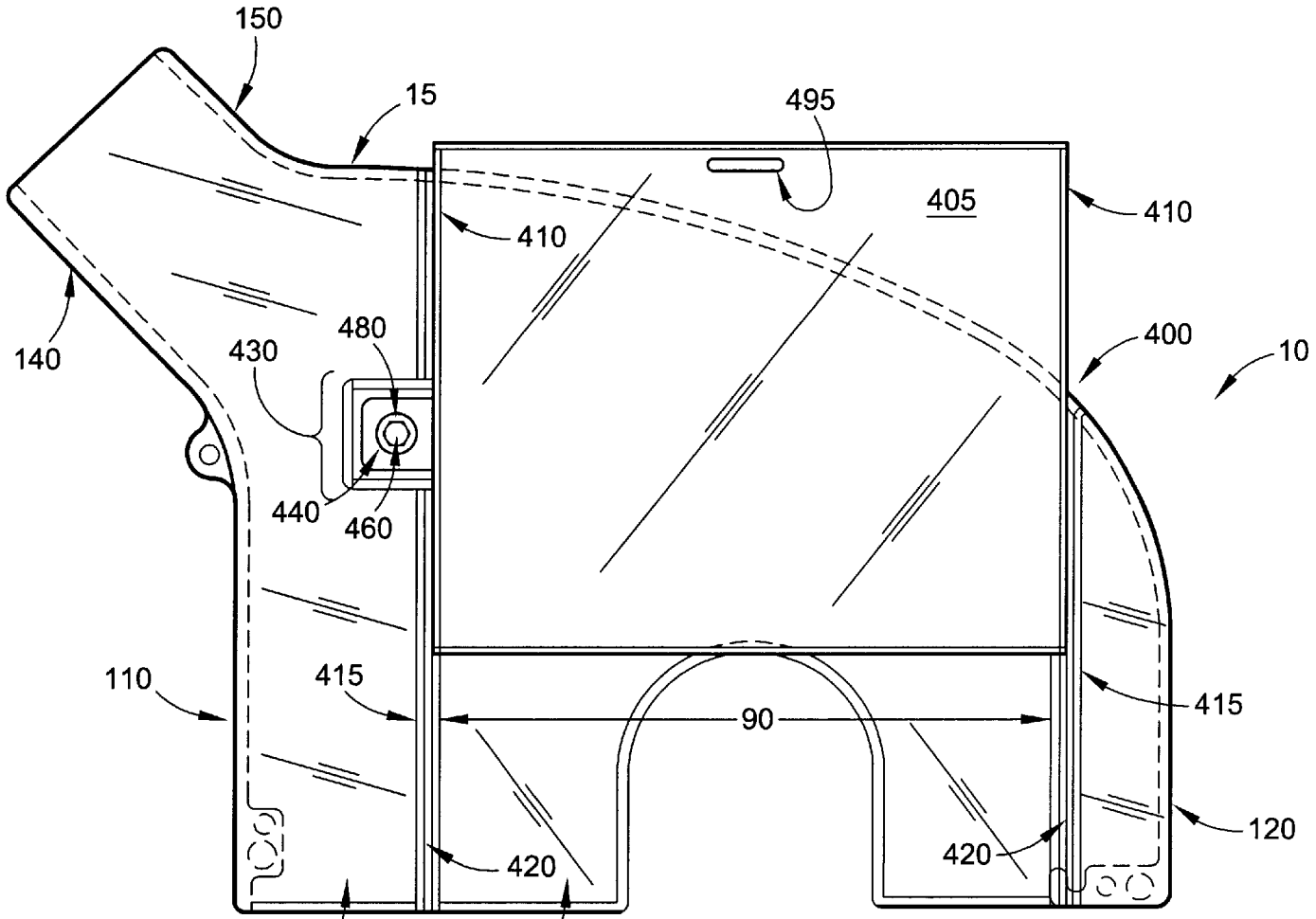
FIG. 5 is a front elevational view of the dust shroud of FIG. 1, and illustrates the sliding access door is in a partially open or raised position.
Figure 6A:
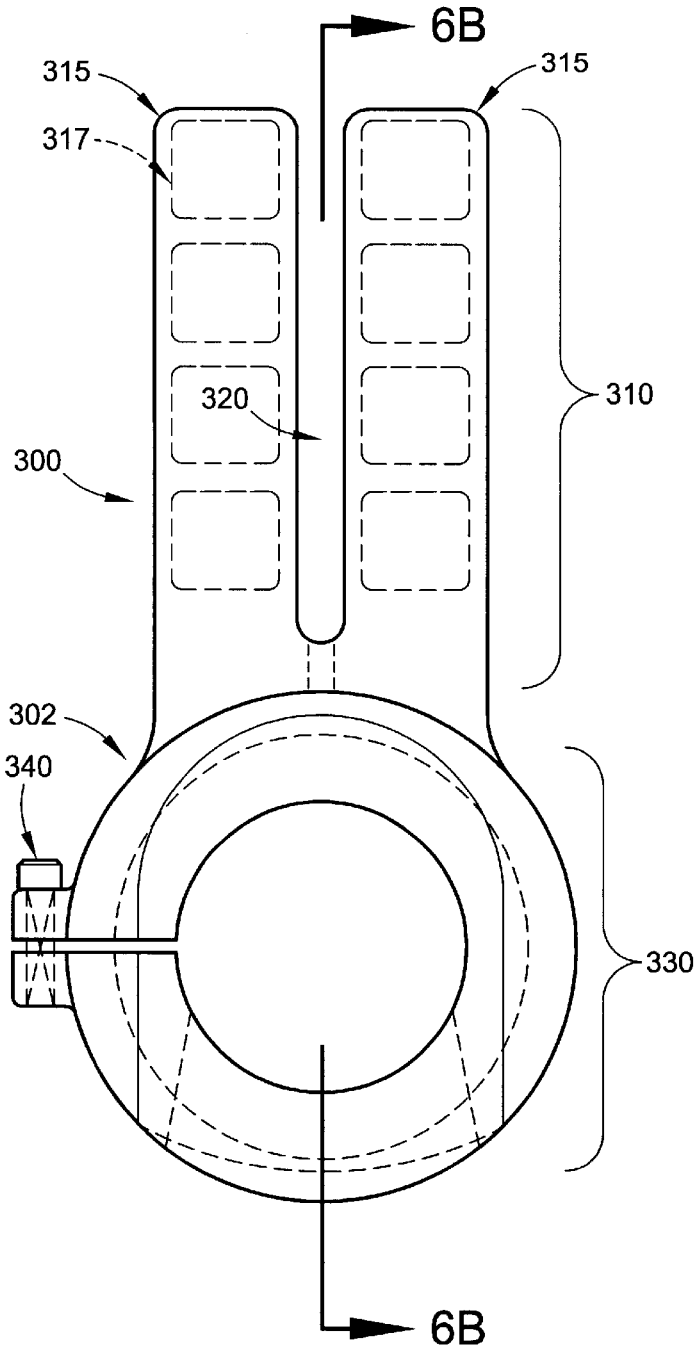
FIG. 6A is a front elevational view of an embodiment of a bracket assembly for mounting the dust shroud of FIG. 1 to a grinding machine.
Figure 6B:
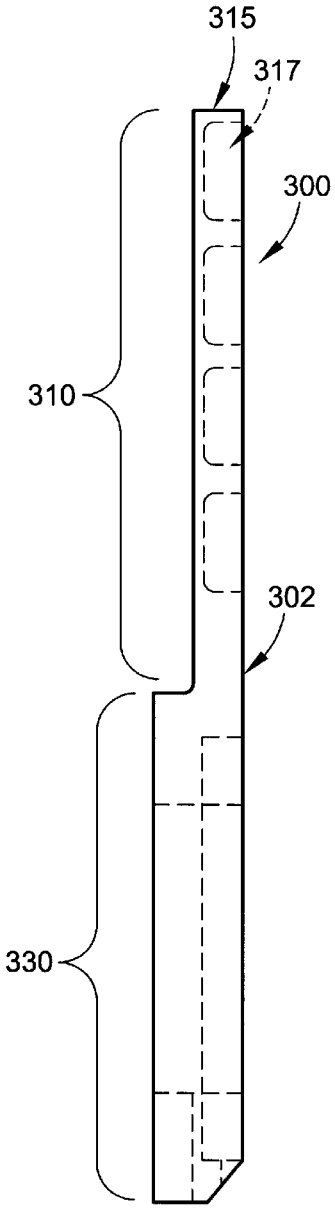
FIG. 6B is a cross-sectional view of the bracket assembly along line 6B—6B of FIG. 6A.

With reference to FIGS. 4A, 4B and 5, an embodiment of a sliding door assembly 400 for the dust shroud 10 will now be described. The sliding door assembly 400 includes a sliding access door 405 for selectively covering the opening 90 on the front side 80 of the dust shroud housing 15. The sliding door 405 includes a pair of elongated dovetail projections 410 on opposite sides of the sliding access door 405. A mounting portion 415 on the front side 80 of the housing 15 includes dovetail slots 420 located at opposite sides of the opening 90 that define opposite sides of the opening 90 and slidably receive the corresponding dovetail projections 410 of the sliding door 405. The mounting portion 415 may be formed integrally with the rest of the die casted shroud 10. By inserting the dovetail projections 410 into the dovetail slots 420, the door becomes vertically slidable within the mounting portion 415. The sliding action of the door 405 allows an operator to selectively position the door 405 in an infinite number of positions between a closed position, where the bottom of the door 405 is flush with the bottom of the shroud housing 15, and an open position, where the door 405 covers little or none of the grinding wheel 60.

The sliding door assembly 400 further includes a clamping arrangement 430 for securing the door 405 in place once a desired door height level or position is obtained. The clamping arrangement 430 includes a mounting plate 440, a washer (not shown) and a threaded fastener 460 adapted to be screwed into a threaded hole (not shown) in the front side 80 of the housing 15. The threaded fastener 460 includes an oversized, plastic head 480 to facilitate turning without the use of tools. Turning the fastener 460 clockwise a sufficient amount within the threaded hole urges the mounting plate 440 against the sliding access door 405, and secures the door 405 in position. Likewise, sufficient turning of the fastener 460 in a counter-clockwise direction looses the mounting plate 440, allowing the door 405 to slide within the mounting portion 415. It will be readily apparent to those skilled in the art that other clamping arrangements or door securing mechanisms may be used.

The sliding access door 405 may include a stop assembly (not shown) that prevents the door 405 from sliding too far down and/or or too far up. The sliding access door 405 may also include a handle 495 that projects outwardly from the top edge of the door 405 to facilitate vertical movement of the door by an operator. Although a handle 495 is shown at the top of the door 405, it will be readily apparent to those skilled in the art that the handle may be located at other locations on the door 405 such as, but not by way of limitation, the bottom of the door 405. Further, the handle 495 may include alternative configurations.

The sliding access door 405 is a significant improvement over prior hinged doors for grinding machine dust shrouds because the hinged doors could only be either fully opened or closed. If the hinged door was closed, it would often interfere with the workpiece 30 during grinding. If the hinged door was open, insufficient vacuum suction occurred in the shroud. The sliding access door 405 along with the clamping arrangement 430 allows the user to selectively position the door 405 so that the door 405 is high enough that the door 405 does not interfere with the workpiece 30 during grinding, but low enough that maximum vacuum suction occurs in the shroud 10, allowing the shroud to function as intended. During use, the door 405 may be opened only as far as necessary to facilitate the changing of grinding wheels, wheel dressing, and checking or measuring of the workpiece 30.

By using the improved, infinitely adjustable sliding access door 405, several advantages can be realized. First, wheel changing, inspection, measurement of the workpiece 30 and overall operator efficiency can be simplified and facilitated due to the ease of operation of the sliding door 405 and the ability to lock the door 405 at any height level. Second, dust and debris levels in the air can be significantly reduced because a higher volume of dust-laden air can be removed with a partially opened door that allows maximum vacuum suction than can be removed with prior art doors in the fully open position. Thus, an operator can open the sliding door 405 only as far as necessary to take advantage of the fullest measure of vacuum suction power to improve the condition of the ambient air surrounding the operator.

Figure 11:
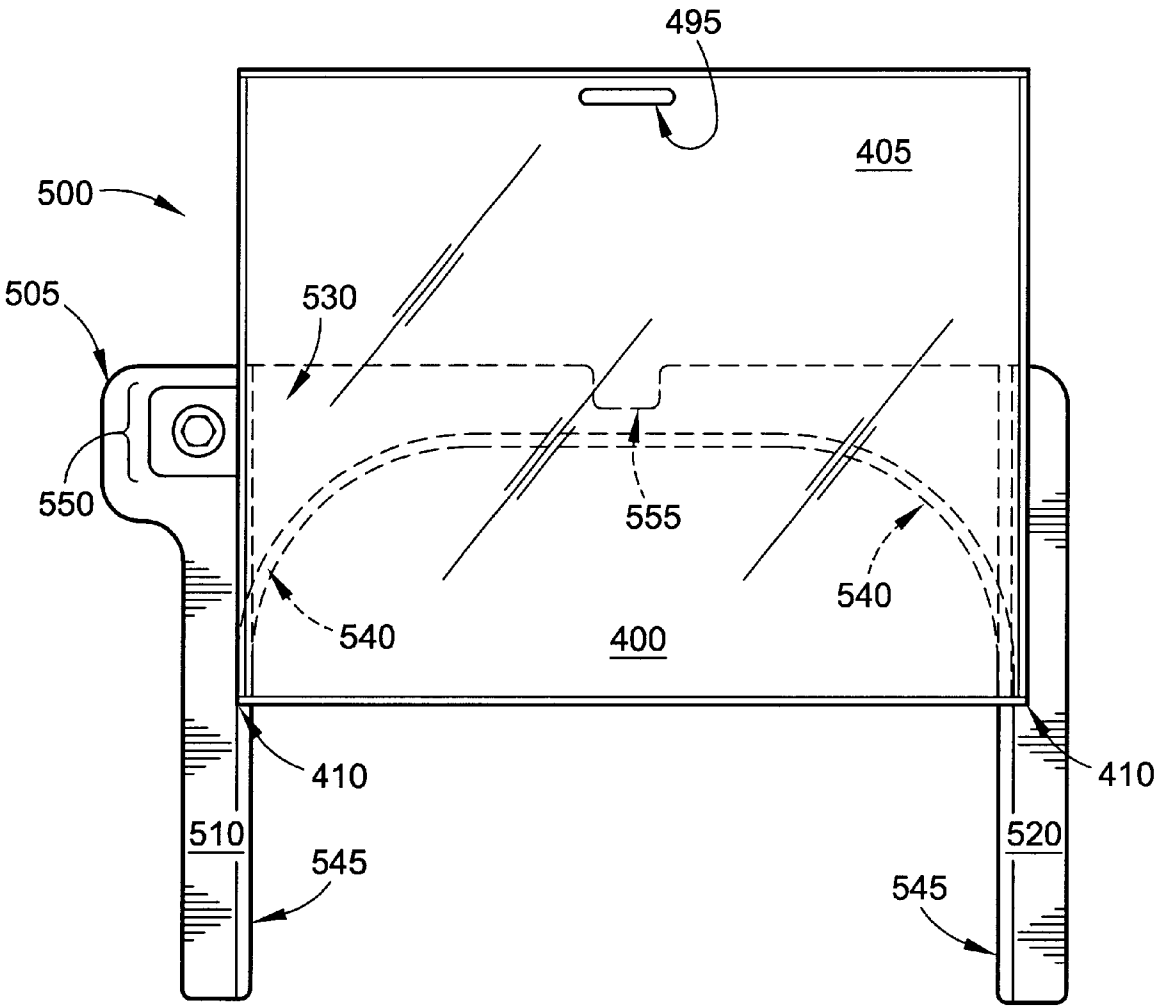
FIG. 11 is a side-elevational view of an alternative embodiment of a sliding door assembly, and illustrates the sliding access door in a partially open or raised position.

With reference to FIG. 11, an additional embodiment of a sliding door assembly 500 for a dust shroud will now be described. The sliding door assembly 500 is preferably used for retrofitting an existing dust shroud such as the dust shroud shown and described in U.S. Pat. No. 4,192,104 to Patenaude. The sliding door assembly 500 includes the aforementioned sliding access door 405 and an adapter bracket 505. The adapter bracket 505 is adapted to be retrofitted to an existing dust shroud and forms a mounting portion for slidably mounting the access door 405 to the dust shroud 10. The adapter bracket 505 is preferably die casted and made of aluminum. The adapter bracket 505 includes a left leg 510, a right leg 520 and a top connecting portion 530. An elongated, arcuate inward projection 540 extends along the bottom of the top connection portion 530 between the left leg 510 and the right leg 520. The bracket legs 510, 520 include inwardly projecting elongated dovetail slots 545 adapted to slidably receive the corresponding elongated dovetail projections 410 of the sliding access door 405. The adapter bracket 505 preferably includes a clamping arrangement 550 similar to the clamping arrangement 430 described above with respect to FIG. 5. The sliding door assembly 500 may include a stop assembly that prevents the door 405 from sliding too far down and/or or too far up. For example a rear side of the access door 405 may include a projection (not shown) that is adapted to abut a catch 555 in the top connecting portion 530 of the adapter bracket 505 when the door 405 is slid downward in the adapter bracket 505.

A method of retrofitting the sliding door assembly 500 to an existing dust shroud will now be described. First, a hinged door from the front wall of the existing dust shroud is unfastened and removed. Next, the adapter bracket 505 is mounted to the front wall of the dust shroud. The adapter bracket 505 is preferably mounted to the front wall around the access opening by affixing the adapter bracket 505 to the front wall with an epoxy resin or silicone sealer. It will be readily apparent to those skilled in the art that other mounting methods may be used. For example, the bracket 505 may be welded, bolted, or screwed to the front wall. If the door 405 is already slidably attached to the adapter bracket 505, retrofitting may end here. If the door 405 is not already slidably attached to the adapter bracket 505, the door 405 may be slidably mounted to the adapter bracket 505 by slidably inserting the door into to the top of the adapter bracket 505.

While preferred embodiments and methods have been shown and described, it will be apparent to one of ordinary skill in the art that numerous alterations may be made without departing from the spirit or scope of the invention. Therefore, the invention is not limited except in accordance with the following claims.

I claim:

1. A surface grinder dust shroud for use with a vacuum source and surface grinder having a rotating grinding wheel, comprising:

a dust shroud housing adapted to be connected to the vacuum source and mounted to the surface grinder, said housing including a bottom and a front wall with a front opening through which the grinding wheel may be accessed;

a sliding door slidably mounted to said front wall of said dust shroud housing for selectively converting said front opening to at least partially expose the grinding wheel from the bottom of the dust shroud housing, which minimizes interference with a workpiece while maintaining substantial vacuum suction from the vacuum source; and a bracket assembly adapted to couple said dust shroud to said surface grinder, said bracket assembly allowing relative angular rotation and radial movement of said dust shroud relative to said grinding wheel.

2. The dust shroud according to claim 1, wherein said sliding door is slidably mounted to said front wall of said dust shroud housing for selective vertical height adjustment of said front opening.

3. The dust shroud according to claim 1, wherein said front wall of said housing includes a mounting portion adapted to slidably receive said sliding door.

4. The dust shroud according to claim 3, wherein said mounting portion is integral with said front wall.

5. The dust shroud according to claim 3, wherein said mounting portion includes an adapter bracket adapted to slidably receive said sliding door.

6. The dust shroud according to claim 5, wherein said adapter bracket comprises a curvilinear aluminum bracket having a left leg, a right leg and a top connecting portion.

7. The dust shroud according to claim 5, wherein said adapter bracket and sliding door are adapted to be retrofitted onto an existing dust shroud.

8. The dust shroud according to claim 5, wherein said adapter bracket is adapted to be affixed to the front wall of said housing.

9. The dust shroud according to claim 5, wherein said adapter bracket is adapted to be fixed to the front wall of said housing with one or more fasteners.

10. The dust shroud according to claim 3, wherein said mounting portion includes a sliding door position control mechanism for controlling the position of said sliding door.

11. The dust shroud according to claim 10, wherein said sliding door position control mechanism is an adjustable clamp.

12. The dust shroud according to claim 2, wherein said sliding door is adapted to be removed entirely from said shroud.

13. The dust shroud according to claim 1, wherein said housing is a die cast aluminum construction.

14. The dust shroud according to claim 13, wherein said die cast aluminum construction is a two-piece construction including a front housing and rear housing.

15. The dust shroud according to claim 14, wherein said front housing and rear housing are fastened together to form said housing.

16. The dust shroud according to claim 1, wherein said bracket assembly includes a first circular clamp section adapted to be mounted to said abrading machine and a second clamp section rotatably mounted to said first circular clamp and adapted to be mounted to said dust shroud.

17. The dust shroud according to claim 1, wherein said front wall further comprises a plurality of indicator mounting holes adapted to receive a workpiece measurement or checking device.

18. A method of controlling the size of a front access opening of a front wall of a dust shroud for use with a vacuum source and a surface grinder having a rotating grinding wheel, comprising:

providing a surface grinder with a rotating grinding wheel for surface grinding a workpiece;

connecting a surface grinder dust shroud to the vacuum source and mounting the surface grinder dust shroud to the surface grinder, said surface grinder dust shroud including a bottom, a front wall with a front opening through which the grinding wheel may be accessed and a sliding door slidably mounted to said front wall; and sliding the door to a location where the grinding wheel is at least partially exposed from the bottom of the dust shroud housing, which minimizes interference with a workpiece while maintaining substantial vacuum suction from the vacuum source.

19. The method according to claim 18, wherein sliding the door includes the step of vertically sliding the door to a desired height.

20. The method according to claim 18, wherein said dust shroud includes a mounting portion integrated with said front wall, and the sliding door is slidably mounted to said mounting portion.

21. The method according to claim 18, wherein said dust shroud includes an adapter bracket mounted to said front wall, and the sliding door is slidably mounted to said adapter bracket.

22. The method according to claim 18, further including locking the position of said sliding door to a desired position using a sliding door position control mechanism.

23. The method according to claim 18, wherein sliding said sliding door includes removing said sliding door entirely from said front wall.

* * * * *